US008082699B1

(12) United States Patent
Kychelhahn

(10) Patent No.: US 8,082,699 B1
(45) Date of Patent: Dec. 27, 2011

(54) MODULAR STRUCTURE

(76) Inventor: Jerry A. Kychelhahn, Palm City, FL (US)

( * ) Notice: Subject to any disclaimer, the term of this patent is extended or adjusted under 35 U.S.C. 154(b) by 10 days.

(21) Appl. No.: 12/357,395

(22) Filed: Jan. 22, 2009

(51) Int. Cl.
*E04H 1/00* (2006.01)

(52) U.S. Cl. ..... 52/79.7; 52/79.9; 52/295; 52/582.1

(58) Field of Classification Search ..... 52/79.4, 52/79.7, 79.8, 79.9, 295, 582.1, 79.1
See application file for complete search history.

(56) References Cited

U.S. PATENT DOCUMENTS

| | | | | | |
|---|---|---|---|---|---|
| 2,691,291 | A | * | 10/1954 | Henderson | 52/79.9 |
| 2,706,313 | A | * | 4/1955 | Radman | 52/79.9 |
| 3,596,417 | A | * | 8/1971 | Zachry | 52/73 |
| 3,694,977 | A | * | 10/1972 | Verman | 52/79.7 |
| 3,793,428 | A | * | 2/1974 | Gordon | 264/250 |
| 3,872,637 | A | | 3/1975 | Murphy | |
| 3,881,283 | A | | 5/1975 | Pender | |
| 3,968,989 | A | | 7/1976 | Schippers | |
| 3,979,919 | A | | 9/1976 | Blonde et al. | |
| 4,127,254 | A | | 11/1978 | Kahan | |
| 4,177,614 | A | * | 12/1979 | Arp | 52/247 |
| 4,228,623 | A | * | 10/1980 | Menosso | 52/79.3 |
| 4,359,847 | A | * | 11/1982 | Schukolinski | 52/396.07 |
| 4,426,060 | A | * | 1/1984 | Csont | 249/13 |
| 4,501,098 | A | * | 2/1985 | Gregory | 52/79.1 |
| 5,243,794 | A | * | 9/1993 | Pikor | 52/136 |
| 5,332,191 | A | | 7/1994 | Nolan | |
| 5,724,775 | A | * | 3/1998 | Zobel et al. | 52/82 |
| 5,941,942 | A | * | 8/1999 | Kleine | 708/632 |
| 6,493,996 | B1 | * | 12/2002 | Alexander et al. | 52/79.9 |
| 6,571,524 | B2 | * | 6/2003 | Pantelides et al. | 52/582.1 |
| 6,651,393 | B2 | * | 11/2003 | Don et al. | 52/79.5 |
| 6,675,540 | B1 | * | 1/2004 | Rokes | 52/143 |
| 7,185,467 | B2 | * | 3/2007 | Marty | 52/425 |
| 7,418,803 | B2 | | 9/2008 | Jenkins et al. | |
| 2003/0205022 | A1 | | 11/2003 | Mawby et al. | |
| 2005/0093190 | A1 | | 5/2005 | Saddik | |

* cited by examiner

*Primary Examiner* — Robert Canfield
*Assistant Examiner* — Jessie Fonseca
(74) *Attorney, Agent, or Firm* — Gold & Rizvi, P.A.; Glenn E. Gold; H. John Rizvi

(57) ABSTRACT

A modular structure includes at least one modular unit comprising a structure base and a structure enclosure carried by the structure base. Each of the structure base and the structure enclosure comprises lightweight concrete providing a significantly improved structure over the currently used fabrication processes. The modular structure is fabricated utilizing tunnel fabrication processes, creating a unitary structure. The structure can be finished at a manufacturing location, then transported and installed at the desired location. Connector plate assemblies are molded into the structure for securing two adjacent modules. Adjacent modules can be oriented perpendicular, parallel, or any angle therebetween to each other.

20 Claims, 10 Drawing Sheets

MODULAR STRUCTURE

FIELD OF THE INVENTION

The present disclosure relates to structures such as manufactured and modular housing and the like. More particularly, the present disclosure relates to a modular structure having modular units multiple ones of which can be selectively attached to each other in the fabrication of a residence or other building.

BACKGROUND OF THE INVENTION

Fabricated structures such as manufactured housing, trailer structures, modular housing and the like are commonly used for housing and business use. Conventional fabricated structures may include a floor assembly and walls and a roof, which are supported by the floor assembly. Each of the floor assembly, the walls and the roof of the structures may be fabricated using one type of material or a combination of materials including plywood, oriented strand board, fiberboard, panels made of compressed Kraft paper and metal sheeting, for example.

Conventional fabricated structures may have a number of drawbacks. The materials and fabrication techniques that are used in the manufacture of fabricated structures may be expensive. Additionally, the floor, walls and roof of fabricated structures may have poor moisture resistance and may be heavy and difficult to install. Moreover, fabricated structures may have a flimsy construction, which renders the structures vulnerable to high winds during hurricanes, tornadoes, and other storm conditions.

Therefore, a modular structure is needed which is simple in construction, durable, transportable, and inexpensive and which includes modular units, multiple ones of which can be selectively attached to each other in the fabrication of a residence or other building.

SUMMARY OF THE INVENTION

The present disclosure is generally directed to a modular structure that may be constructed of a strong and durable material such as a lightweight concrete material and is simple and inexpensive to fabricate and transportable from a fabrication facility to a deployment site. The modular structure may include single or multiple modular units, which can be selectively attached to each other to form a residence or other building of selected size and configuration.

In one aspect, the modular structure may include:

at least one modular unit comprising:

a structure base;

a structure enclosure carried by the structure base; and wherein each of the structure base and the structure enclosure is fabricated primarily of a material being a lightweight concrete material bonded to and covering a reinforcing material.

In another aspect, the reinforcing material is steel in the form of what is commonly known as "rebar".

Another aspect provides a structure that is assembled utilizing a forming process, wherein the structure is fabricated via forming a structure base, followed by forming and pouring wall and roof portions during a single mold pouring process. The wall and roof portions form a unitary enclosure. The unitary structure may be created utilizing a process by which the wall and roof portions are formed and poured in a single concrete pour, such as via a tunnel forming process, a wall and shored ceiling forming process, and any other process allowing such unit homogeneity.

In another aspect, the structure base may include a perimeter footer and optional cross rib supports as structurally required and a floor normally extending the length and width of the modular unit, including the area within the extremities of the footer.

In still another aspect, a plurality of structure reinforcing elements, which may include reinforcing steel or other reinforcing materials, may extend from the structure base into the structure enclosure.

In another aspect, the structure enclosure may include a pair of spaced-apart side walls carried by the structure base and at least one structure roof section carried by the side walls.

In still another aspect, at least one end wall may be carried by the structure base and at least one structure roof section carried by the end walls and side walls.

In yet another aspect, a plurality of connector plate assemblies may be carried by at least one of the structure base and the structure enclosure.

In another aspect, each wall may include such openings as may be required in the structure enclosure to allow for the placement of doors and windows in the enclosure as may be architecturally specified.

In a still further aspect, the plurality of connector plate assemblies may each include a connector plate and a plurality of connector plate anchor members carried by the connector plate and extending into the structure base and/or the structure enclosure.

In another aspect, a connector bracket having a bracket base may be provided on the connector plate and a bracket flange may be provided on the bracket base.

In another aspect, a plurality of lift insert assemblies may be carried by the structure base and the structure enclosure.

In another aspect, the plurality of lift insert assemblies may each include a plurality of list insert anchor members carried by the lift assembly plate which includes a plate flange with thru hole for lifting of the modular unit.

These and other aspects, features, and advantages of the present invention will become more readily apparent from the attached drawings and the detailed description of the preferred embodiments, which follow.

BRIEF DESCRIPTION OF THE DRAWINGS

The illustrative embodiments of the disclosure will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description.

The present disclosure is generally directed to a modular structure that may be constructed of a strong and durable material such as a lightweight concrete material and is simple and inexpensive to fabricate. The modular structure may include a single modular unit or multiple modular units, which can be selectively attached to each other to form a residence or other building of selected size and configuration.

Figure 1:
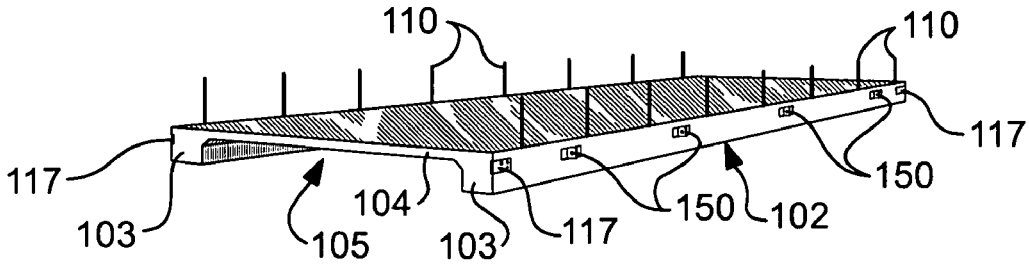
FIG. 1 is a perspective view of a structure base of a modular unit.
Figure 2:
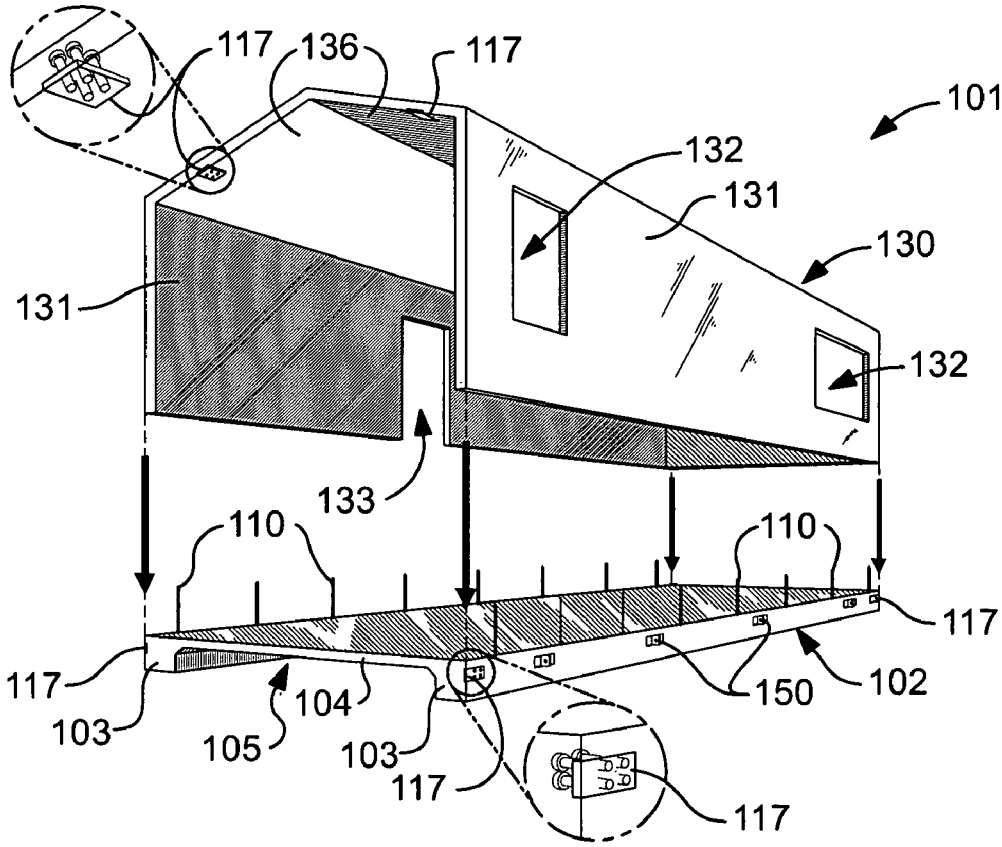
FIG. 2 is an exploded perspective view of a modular unit, more particularly illustrating an exemplary method of attaching a structure enclosure to a structure base of the modular unit.

Referring to the drawings, an illustrative embodiment of the modular structure is generally indicated by reference numeral 100. As illustrated in FIGS. 4-7, the modular structure 100 may include multiple modular units 101 which can be selectively attached to each other to fabricate a modular structure 100 having a selected size and configuration, as will be hereinafter described. As illustrated in FIGS. 1 and 2, each modular unit 101 of the modular structure 100 may include a structure base 102. A structure enclosure 130 may be provided on the structure base 102. The structure base 102 and the structure enclosure 130 may each be a lightweight material such as molded lightweight or foamed concrete, for example and without limitation. The modular unit 101 can be formed via a two-stage pouring process into forms, a process of fabricating the structure base 102, then forming or molding the structure enclosure 130 onto the structure base 102, or forming via two separate processes and subsequently attaching the two components to one another.

Figure 3:
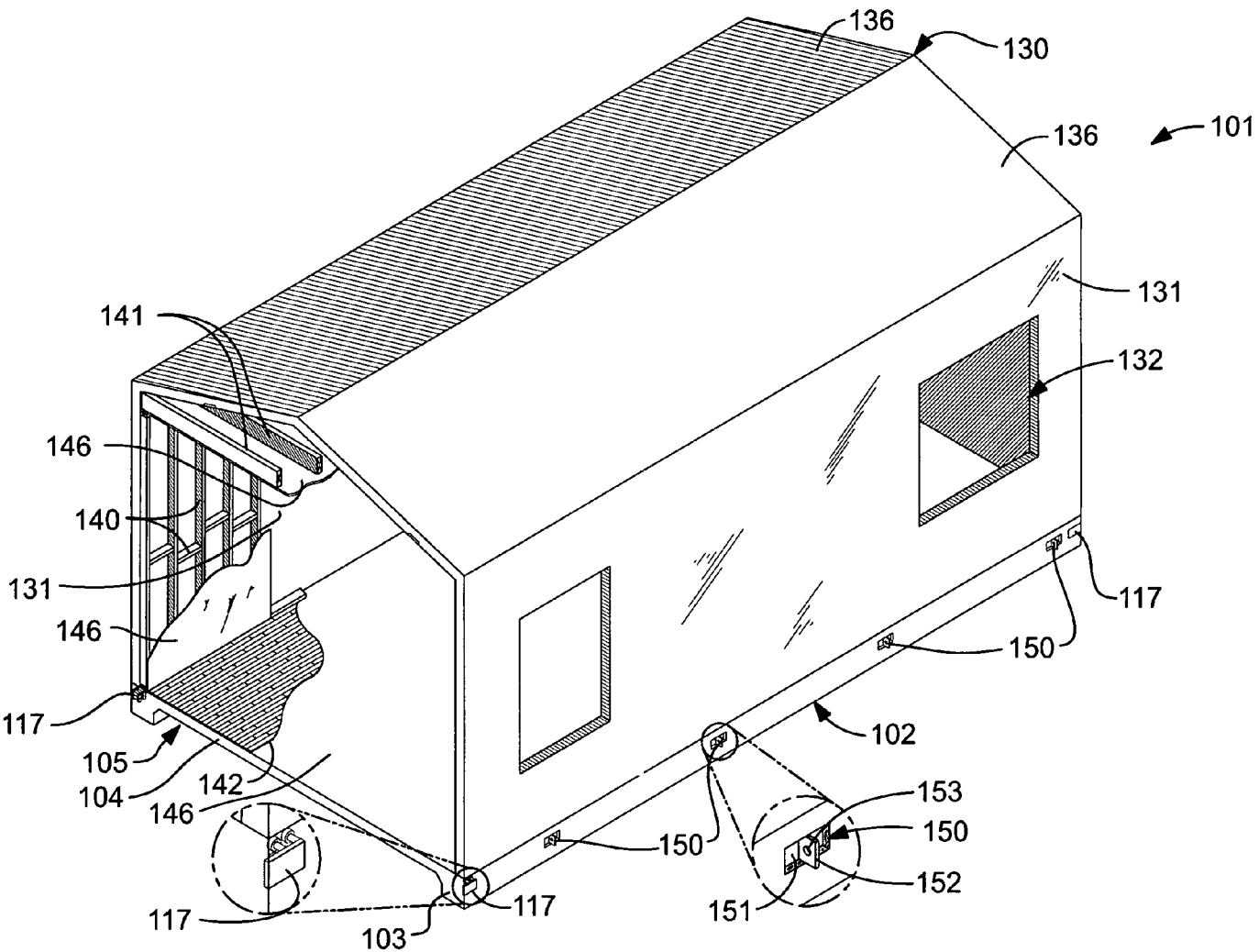
FIG. 3 is a perspective view, partially in section, of a modular unit, additionally illustrating enlarged perspective views of an exemplary connector plate assembly and an exemplary unit lift assembly, respectively.

As illustrated in FIG. 1, the structure base 102 may include a footer 103, located on two or more sides, and a floor 104 that covers the footer 103 and the area inside the footer 103, formed as an integral structure. The footer 103 can optionally be provided along the entire perimeter of the floor 104. In some embodiments, the structure base 102 and the structure enclosure 130 of each modular unit 101 may have a generally elongated, rectangular shape. Accordingly, the footer 103 and any corresponding structural footer ribs (not shown) inside of the perimeter footer 103 may be thicker than the floor 104 and may be disposed in generally parallel, spaced-apart relationship to each other. A foundation space 105 may be defined by and between the perimeter footer 103. In some implementations, a footer 103 may be required along the entire perimeter of the floor 104 such that all four edges are thicker than the center of the structure base 102. In some implementations, structure reinforcing elements 110 may extend beyond the plane of the floor 104 proximate an area along at least two edges of the structure base, each edge corresponding to a structure wall 131, 138. The structure reinforcing elements 110 are preferably arranged in a spaced-apart relationship to each other. In some embodiments, the structure reinforcing elements 110 may extend along three or all four edges of the structure foundation 102. The structure reinforcing elements 110 may be rebar or tensioning bars or beams, as examples and without limitation. As illustrated in FIG. 3, the structure base 102 may include a foundation support structure, which may be a network of wood, metal, and/or other reinforcing material as exemplified by the potential requirement for fabrication of composite flooring, and the like. In some embodiments, the lightweight concrete may be foamed concrete, for example and without limitation.

As illustrated in FIGS. 2 and 3, the structure enclosure 130 of each modular unit 101 may include a pair of spaced-apart side walls 131 which extend upwardly from the structure base 102. In some embodiments, the structure reinforcing elements 110 (FIG. 1) which extend from the structure base 102 may extend into the side walls 131 of the structure enclosure 130 to anchor the structure enclosure 130 on the structure base 102 and to meet the structural requirements for rebar laps and to tie the rebar or other reinforcing material in the base to the reinforcing materials in the enclosure. Window openings 132 and/or door openings 133 may extend through each side walls 131.

At least one roof section 136 may be provided on the side walls 131. In some embodiments, a gabled roof 136 may extend from the respective side walls 131. In some embodiments, a single roof section, such as a flat or shed roof, (not illustrated) may be supported by the side walls 131. An end wall 138 (FIG. 4) may be provided on at least one end of the structure enclosure 130 and may provide additional support to the roof 136. A modular unit 101 having an end wall 138 (FIG. 4) may be referred to as a terminal unit. A modular unit 101 having the end wall 138 omitted may be referred to as a central modular unit.

As illustrated in FIG. 3, in some embodiments, the structure enclosure 130 of each modular unit 101 may include an interior finish support furring 140 and ceiling beams 141, which is generally fabricated of furring strips or long thin strips of wood or metal used to make backing surfaces to support the finished surfaces in a room. A surface finish material 146, such as drywall, for example and construction components which may include insulation and plumbing and electrical appurtenances and without limitation, is provided on or within or between the interior finish support furring 140 to provide a finished appearance and necessary utility to the side walls 131, the roof sections 136 and the structure end wall 138. Other finish items can be installed, such as windows, doors, insulation, plumbing, electrical components, and the like, at the manufacturing location, at the site of the assembly of the modular structure 100.

Figure 5:
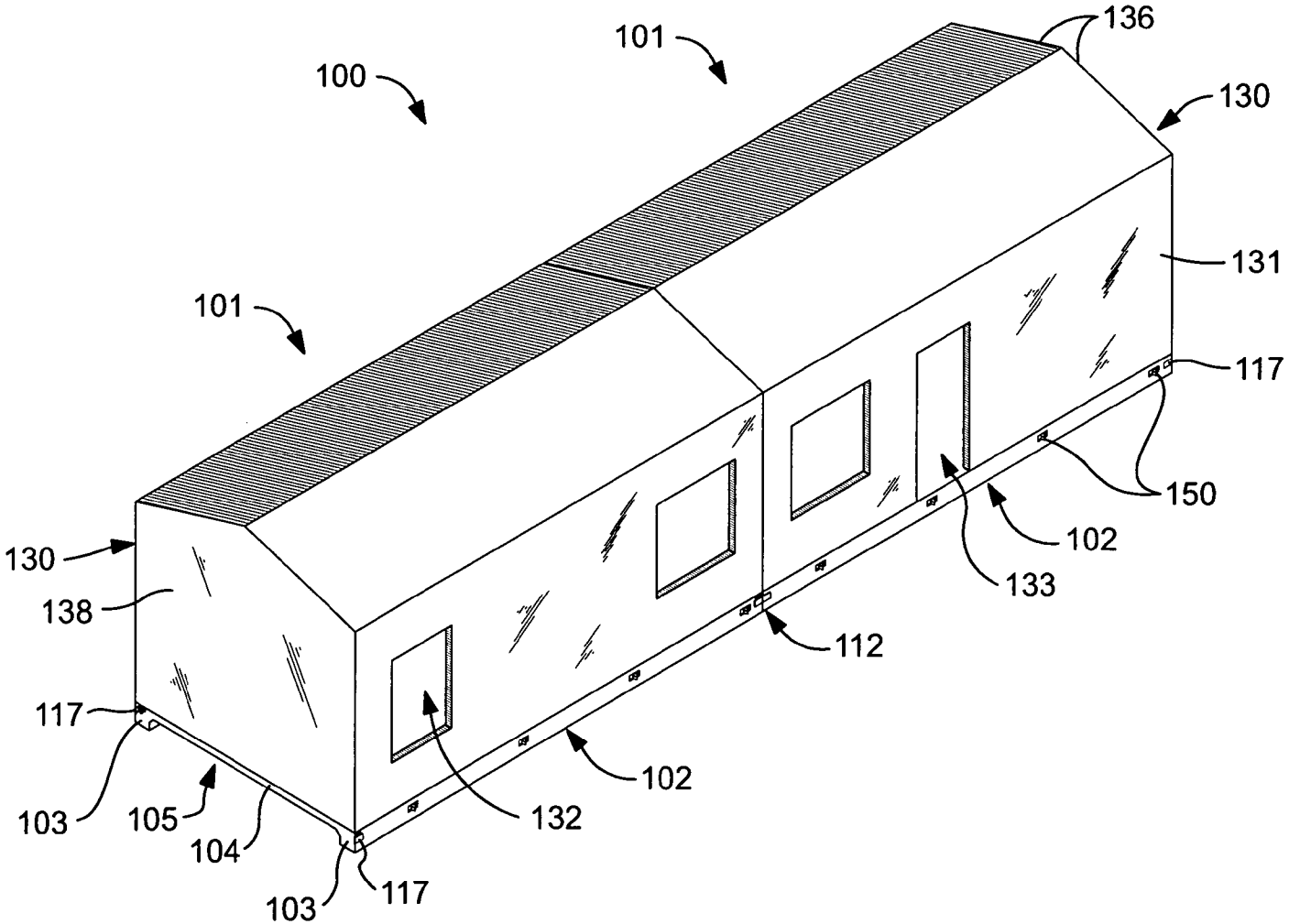
FIG. 5 is a perspective view of a modular structure formed having a pair of modular units attached to each other in end-to-end relationship with respect to each other in fabrication of an illustrative embodiment of the modular structure.
Figure 6:
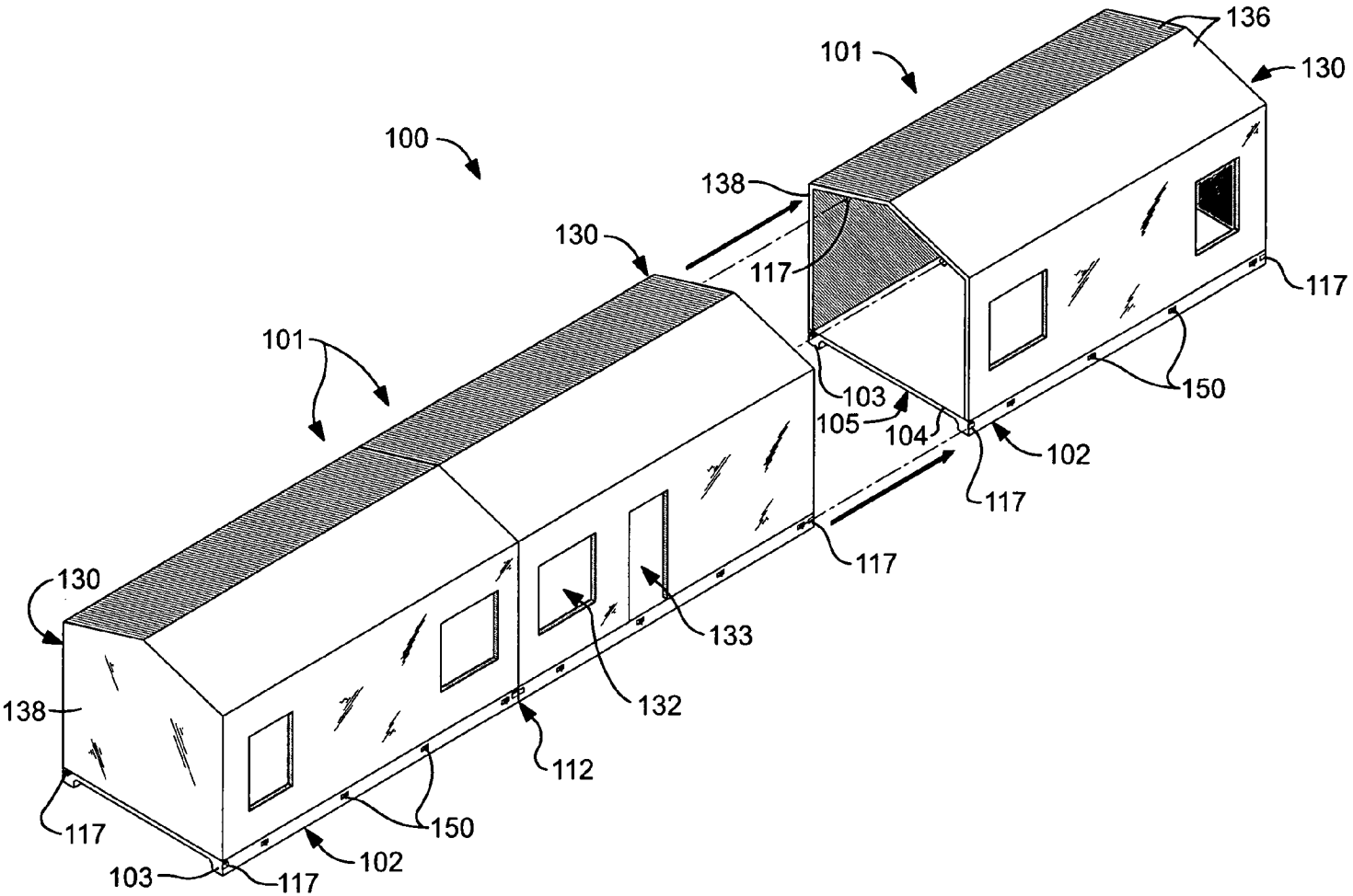
FIG. 6 is a perspective view of a modular structure formed having a pair of attached modular units, more particularly illustrating attachment of a third modular unit to an end of the adjacent attached modular units in fabrication of an illustrative embodiment of the modular structure forming an end to end configuration.
Figure 7:
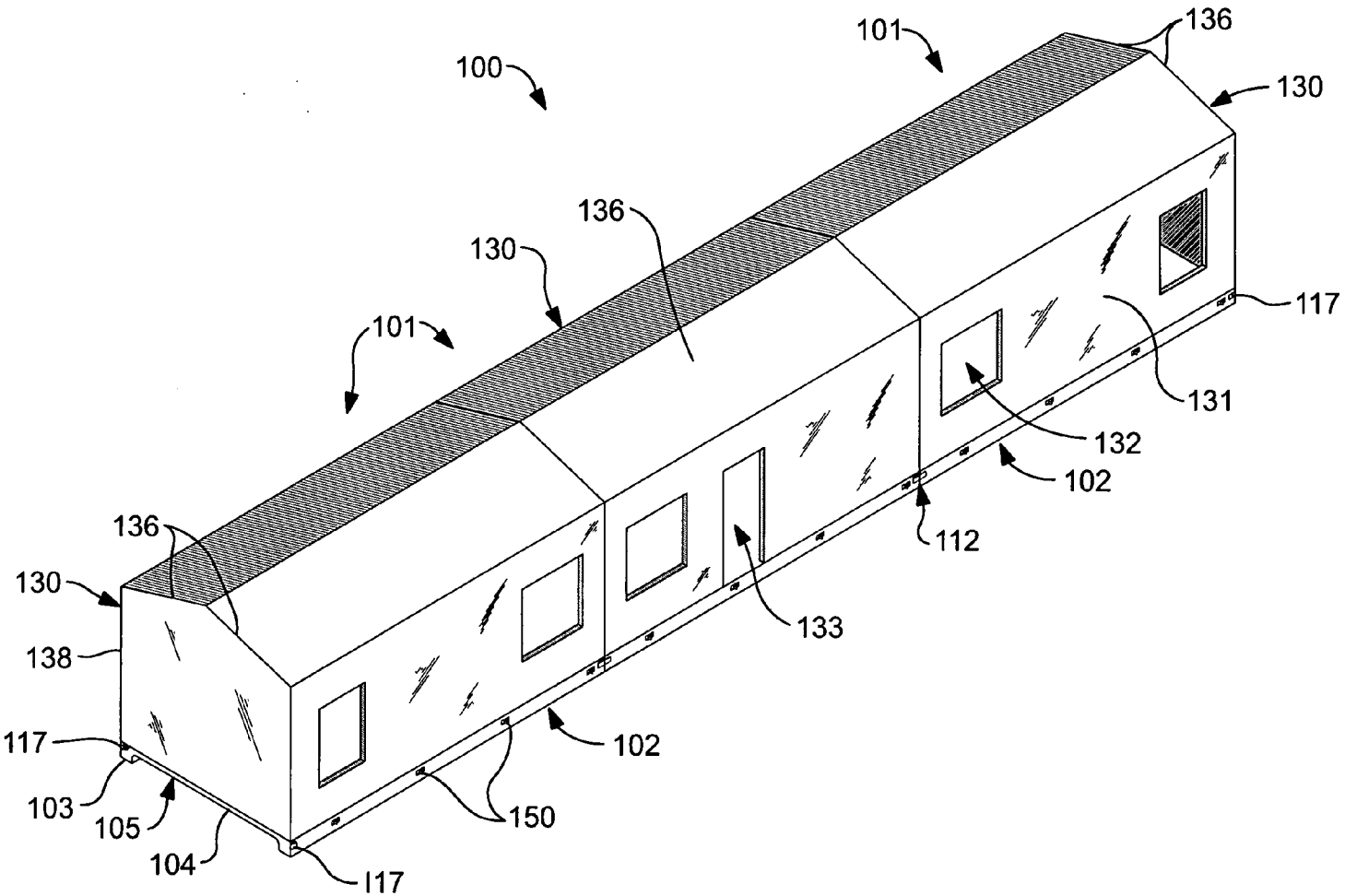
FIG. 7 is a perspective view of a modular structure formed having three modular units attached to each other in end-to-end relationship to each other in fabrication of an illustrative embodiment of the modular structure.
Figure 9:
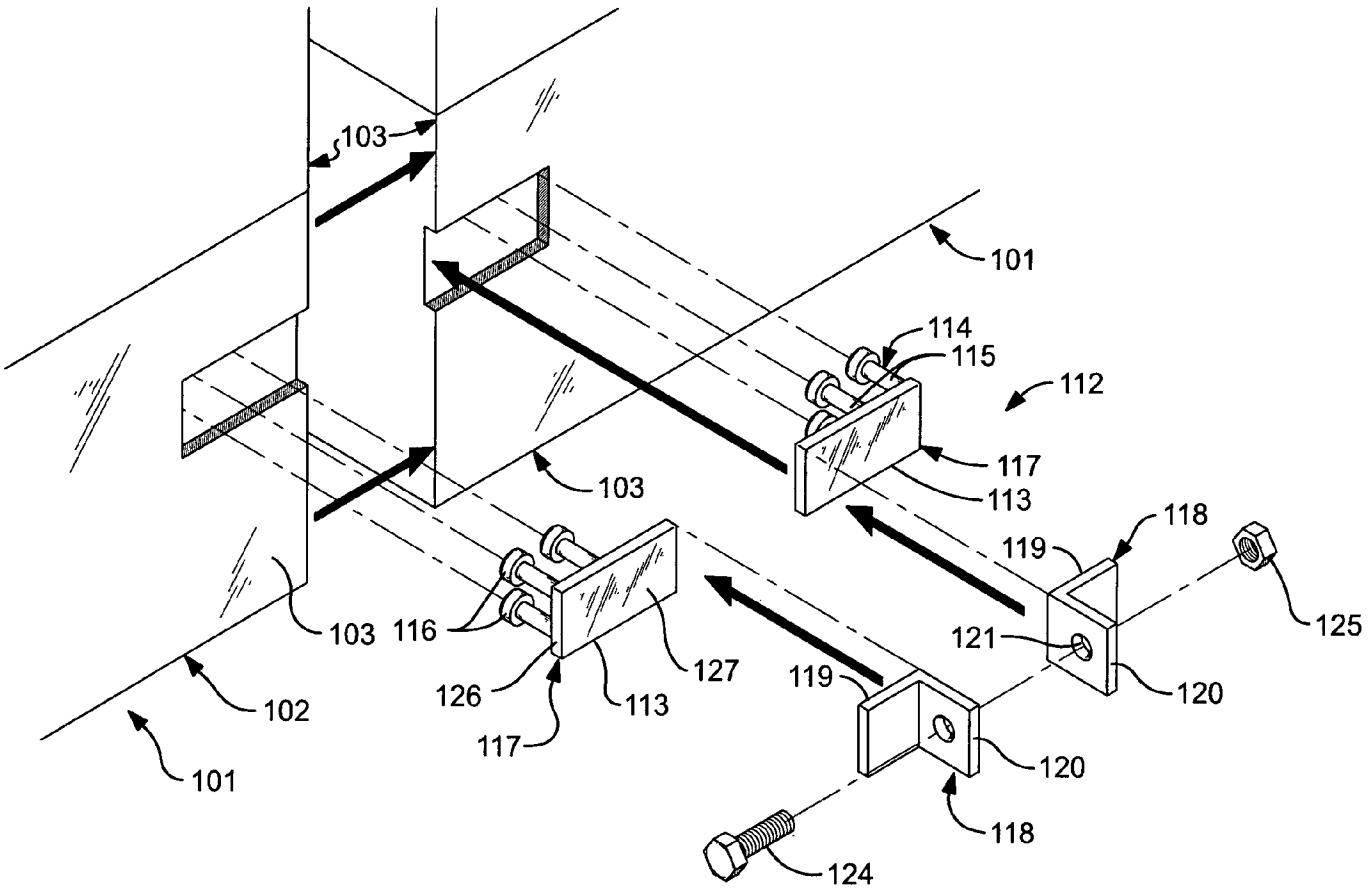
FIG. 9 is an exploded perspective view of an illustrative unit connector assembly in attachment of adjacent modular units to each other in fabrication of an illustrative embodiment of the modular structure.

As illustrated in FIGS. 5-7, unit connector assemblies 112 may be used to attach adjacent modular units 101 to each other in the modular structure 100. As illustrated in FIG. 9, each unit connector assembly 112 may include a connector plate assembly 117, which is provided at each connecting end of each modular unit 101. Each connector plate assembly 117 may include a connector plate 113 which may be steel, for example and without limitation. Multiple connector plate anchor members 114 may extend from a first connector plate surface 126 of the connector plate 113. Each connector plate anchor member 114 may include a generally elongated anchor member shaft 115, which extends from the connector plate 113 and a shaft head 116, which terminates the anchor member shaft 115. In fabrication of the modular structure 100, the connector plate 113 of each connector plate assembly 117 may be partially embedded in, flush/or standing proud with the foundation side portion 103 of the structure base 102. The connector plate anchor members 114 may extend into the structure base 102 to anchor the connector plate 113 to the structure base 102. As illustrated in FIGS. 1 and 2, in some embodiments, at least two connector plate assemblies 117 may be provided at each end and on respective sides of the structure base 102 to facilitate assembly of at least two unit connector assemblies 112 on each connecting end of each modular unit 101. Additional connector plate assemblies 117 may be provided on the respective roof sections 136, as illustrated, and/or on the respective side walls 131 of the structure enclosure 130 of each modular unit 101.

Figure 10:
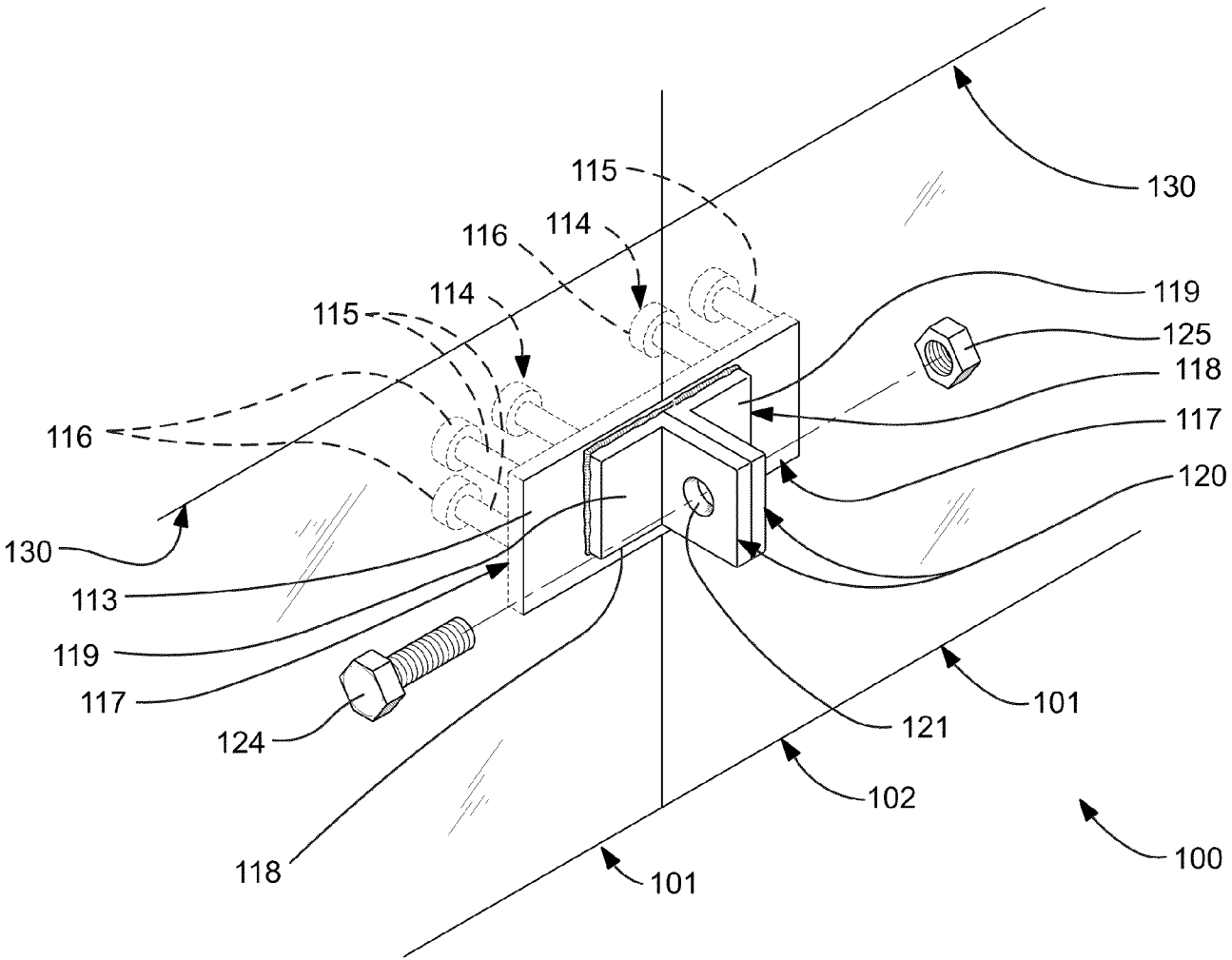
FIG. 10 is a perspective view of the illustrative unit connector assembly illustrated in FIG. 9, more particularly insertion of a fastener through a pair of connector brackets in the unit connector assembly.

As further illustrated in FIG. 9, in each unit connector assembly 112, which attaches adjacent modular units 101 to each other in the modular structure 100, a pair of connector brackets 118 may attach the connector plate assemblies 117 on the respective modular units 101. Each connector bracket 118 may be an L-shaped angled connector bracket having a bracket base 119 and a bracket flange 120, which extends from the bracket base 119. A strengthening wedge or structural fillet (not illustrated) may be included on each connector bracket 118. As illustrated in FIG. 10, the bracket base 119 of each connector bracket 118 may be attached to a second connector plate surface 127 on the connector plate 113 of each corresponding connector plate assembly 117 such as via a weld 128, for example and without limitation. A fastener 124 may be extended through registering fastener openings 121 provided in the bracket flanges 120 of the adjacent connector brackets 118. A nut 125 may be threaded on the fastener 124.

As illustrated in FIGS. 1-3, in some embodiments, multiple unit lift assemblies 150 may be provided along the exterior surface about a perimeter of the structure base 102 to facilitate lifting and transport of each modular unit 101 as deemed necessary. As illustrated in FIG. 3, each unit lift assembly 150 may include a lift assembly plate 151 which may be embedded in the structure base 102. The lift assembly plate 151 may have anchor members, similar to the connector plate anchor members 114, which may extend into the structure base 102 to anchor the lift assembly plate 151 to the structure base 102. A lifting flange 152 may extend from the lift assembly plate 151. A lifting plate opening 153 may extend through the lifting flange 152. Each unit lift assembly 150 may have an alternative design which is suitable to facilitate lifting of each modular unit 101 using a suitable lifting or hoisting apparatus (not illustrated).

Each modular unit 101 of the modular structure 100 may be fabricated using conventional molding techniques known by those skilled in the art. In one method of fabrication, the structure base 102 may be poured initially and cured, after which the structure enclosure 130 may be poured on the structure base 102 and cured. A foundation mold (not illustrated), which corresponds to the size and shape of the structure base 102 to be fabricated may then be placed around the base structure. Lightweight concrete may then be poured into the base form, which is subsequently separated from the structure base 102 after hardening and curing of the lightweight concrete. The structure enclosure 130 is then formed onto the structure base 102, using a similar forming and pouring process. Once cured, the form can be removed and additional finishing can be accomplished on the modular unit 101. Furring 140 (FIG. 3) may then be assembled onto the modular unit 101 for finishing. A surface finish material 146 may then applied covering the furring 140, providing features, looks, and the feel of commonly constructed structures. A dropped ceiling may be installed as illustrated in FIG. 3. Flooring 142 can be disposed upon the exposed interior surface of the structure base 102.

In yet another method of fabrication of each modular unit 101, the structure base 102 and the structure enclosure 130 may be molded independent of each other and subsequently assembled as a unitary structure. The structure enclosure 130 may then be placed on the structure base 102. Prior to placement of the structure enclosure 130 on the structure base 102, reinforcing element channels (not illustrated) may be provided in each side wall 131 of the structure enclosure 130 to receive the respective structure reinforcing elements 110 of the structure base 102 as the structure enclosure 130 is lowered onto the structure base 102.

Figure 4:
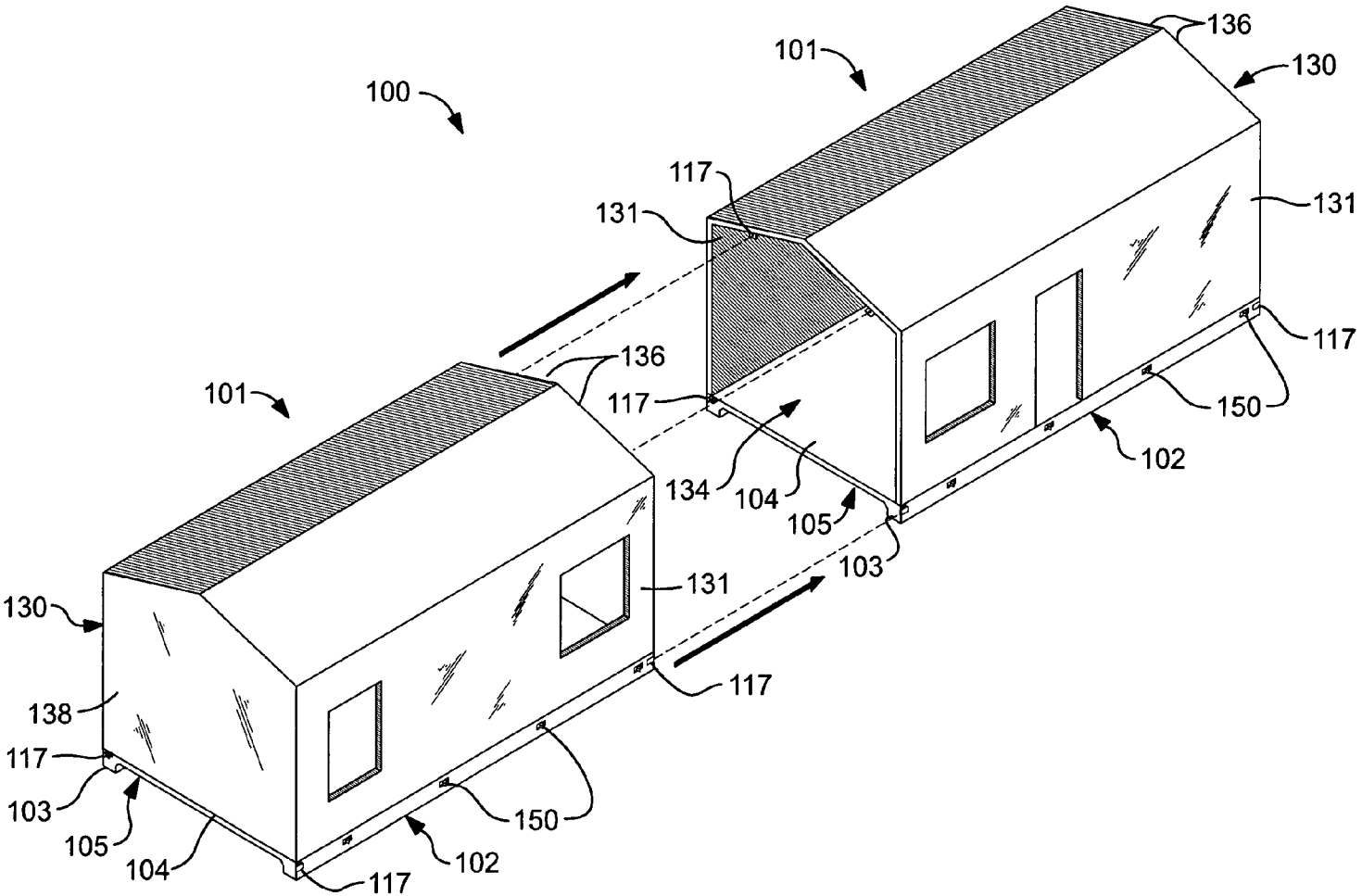
FIG. 4 is a perspective view of a modular structure formed having a pair of modular units, more particularly illustrating an exemplary method of attaching the modular units in end-to-end relationship to each other in fabrication of a first illustrative embodiment of a modular structure.
Figure 11:
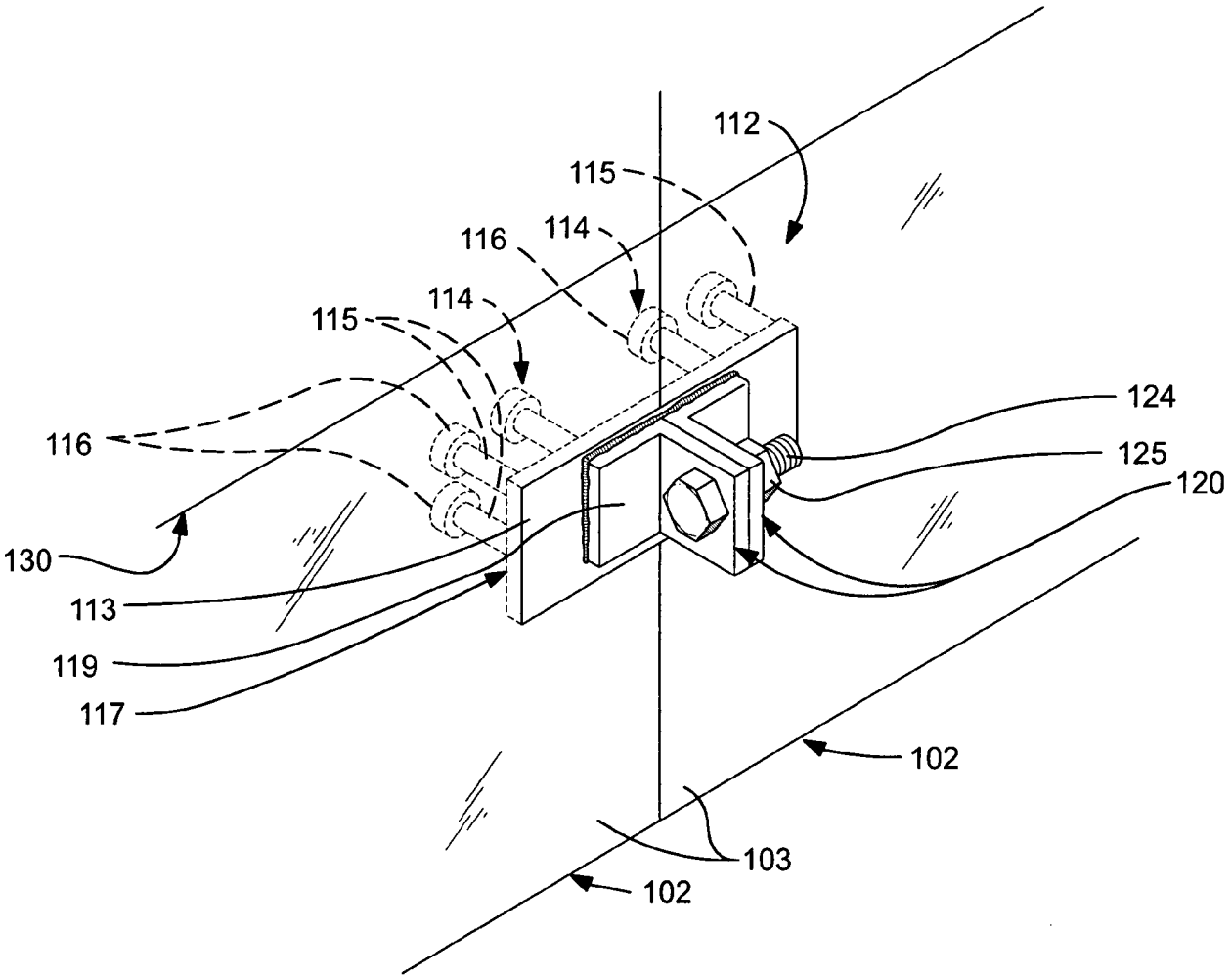
FIG. 11 is a perspective view of the illustrative unit connector assembly illustrated in FIG. 9, with the connector brackets fastened to each other in the unit connector assembly.

As illustrated in FIGS. 4-7, a modular structure 100 may be assembled in a linear configuration by attaching multiple modular units 101 to each other in end-to-end relationship. Accordingly, as illustrated in FIG. 4, the open ends of a pair of modular units 101 may be attached or coupled to each other by fastening the connector plate assemblies 117 at the end of one modular unit 101 to the respective connector plate assemblies 117 at the facing end of the other modular unit 101. This may be accomplished as was heretofore described with respect to FIGS. 9-11, by attaching the connector brackets 118 to the connector plates 113 of the respective connector plate assemblies 117; extending a fastener 124 through the registering fastener openings 121 in the connector brackets 118; and threading a nut 125 on the fastener 124. As illustrated in FIGS. 5-7, it will be appreciated by those skilled in the art that any number of additional modular units 101 may be sequentially attached or coupled to the terminal modular unit 101 in like manner to assemble a modular structure 100 having a selected length and number of modular units 101. The terminal modular units 101 on the respective ends of the modular structure 100 may be fabricated with one structure end wall 138, whereas the modular units 101 between the terminal modular units 101 may be fabricated without the structure end wall(s) 138, to provide a continuous structure interior 134 (FIGS. 4 and 6) throughout the length of the modular structure 100. In some embodiments, an expansion joint (not illustrated) may be placed between the adjacent modular units 101 in the modular structure 100 to accommodate expansion and contraction of the modular units 101 with respect to each other. Each expansion joint may be an extruded resilient material such as rubber, silicone or the like. It is desirable that the modular structure 100 be fabricated of a shape and size suitable for transporting on public roadways. Prior to assembly of the modular structure 100, the unit lift assemblies 150 provided along the sides of the structure base 102 of each modular unit 101 may be engaged by a suitable lifting or hoisting apparatus (not illustrated) to lift each modular unit 101 onto a transport vehicle (not illustrated) such as a truck or railcar for transport of the modular units 101 to the site of assembly of the modular structure 100.

Figure 8:
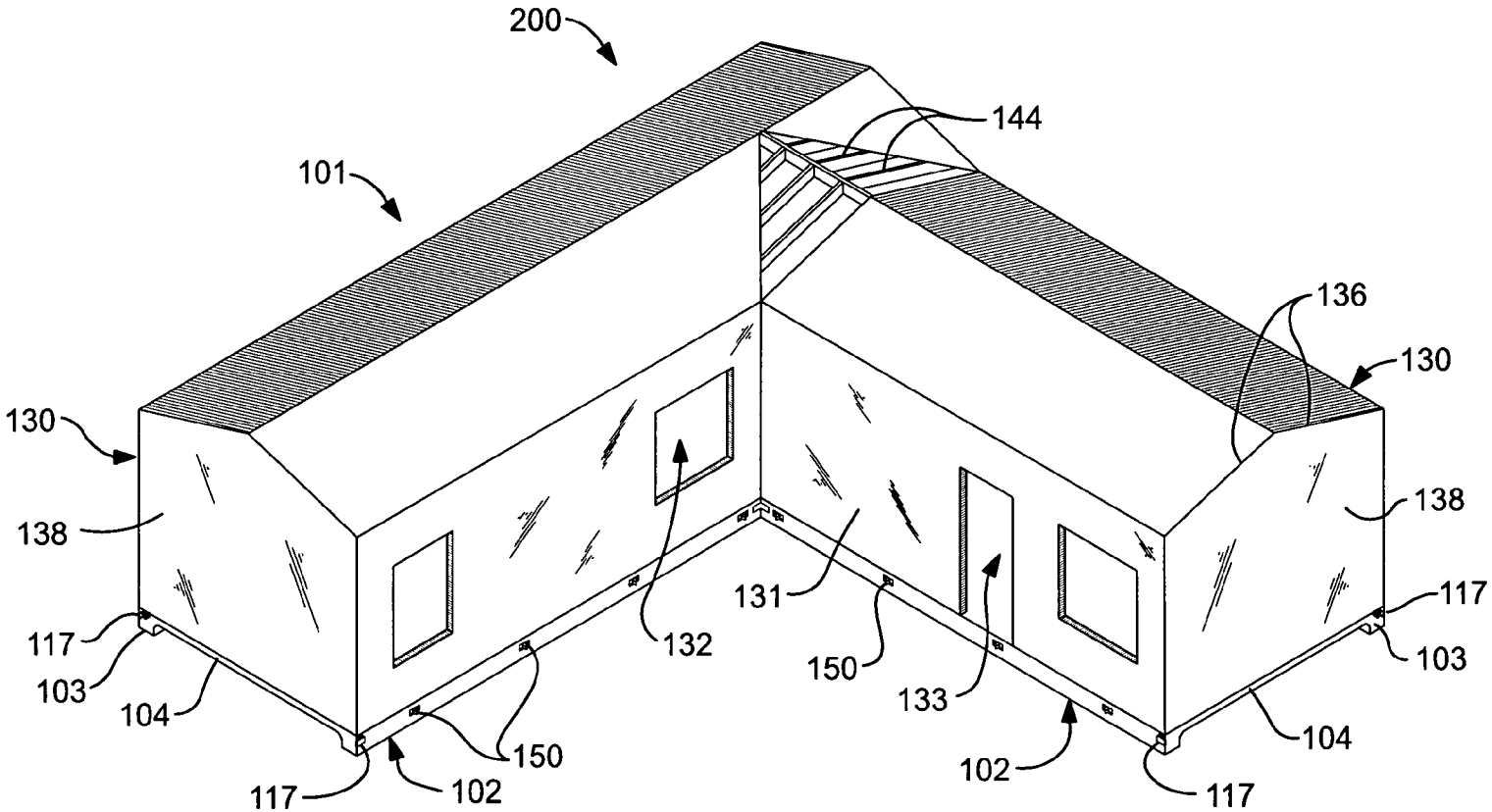
FIG. 8 is a perspective view of another illustrative embodiment of the modular structure, with one modular unit oriented in perpendicular relationship with respect to another modular unit.

As illustrated in FIG. 8, in some applications the modular structure 100 may be assembled in a non-linear configuration, referenced as modular structure 200. Accordingly, a first one of the modular units 101 may be fabricated with a side opening (not illustrated) in a side wall 131 thereof. The open end of a second modular unit 101 may then be placed in communication with the opening in the first modular unit 101 and the second modular unit 101 coupled to the first modular unit 101 via multiple unit connector assemblies 112. The roof sections 136 of the second modular unit 101 may then be extended to the pitch of the roof sections 136 on the first modular unit 101 by fabrication of a roof frame 144 followed by the application of a covering material to the roof frame 144.

It will be appreciated by those skilled in the art that the simplicity in construction of the modular structure enables a number of variations of the modular structure configurations depending on the particular needs and desires of the user. Although the preferred embodiments taught herein show the assembly of adjacent modular units 101 having the openings positioned proximate the other, it is understood that a modular unit 101 can be assembled to an adjacently positioned modular unit 101 at any location, angle, and the like. A pathway can be provided between the two connecting modular units 100 as needed.

While the illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A modular structure, comprising:

a first modular unit comprising:

a first monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge along each end opening such that a portion of the connector assembly remains exposed;

a first monolithic structure base having an upper surface bounded by a peripheral base edge;

a plurality of structure reinforcement elements extending upward from a peripheral edge of the first monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the first monolithic structure base along an edge respective to each of the at least one end opening, the mechanical connector assemblies positioned having a spatial arrangement, such that a portion of the connector assembly remains exposed;

wherein said first monolithic structure enclosure being of a size and shape for a building and carried by said first monolithic structure base;

wherein said first monolithic structure base is formed via a poured concrete material;

wherein said first monolithic structure enclosure is a unitary structure formed via a form and pouring process; and a second modular unit comprising:

a second monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge such that a portion of the connector assembly remains exposed;

a second monolithic structure base having an upper surface bounded by a peripheral base edge;

a plurality of structure reinforcement elements extending upward from a peripheral edge of the second monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the second monolithic structure base along an edge respective to each of the at least one end opening, the mechanical connector assemblies positioned having a spatial arrangement, such that a portion of the connector assembly remains exposed and wherein each of the plurality of mechanical connector assemblies are positioned in registration with each mating mechanical connector assembly of a mating end opening of the first modular unit;

wherein said second monolithic structure enclosure being of a size and shape for a building and carried by said second monolithic structure base;

wherein said second monolithic structure base is formed via a poured concrete material;

wherein said second monolithic structure enclosure is a unitary structure formed via a form and pouring process;

wherein the second modular unit is positioned with the second modular end opening abutting the first modular unit one end opening wherein the second modular unit mechanical connector assemblies are in alignment with the first modular unit mechanical connector assemblies in a manner enabling the end openings to mechanically fastened to one another; and wherein each first modular unit mechanical connector assembly is mechanically coupled to each respective second modular unit mechanical connector assembly, thus mechanically joining the first modular unit and the second modular unit together.

2. The modular structure of claim 1 further comprising at least two footers formed along and extending downward from at least two opposing edges of said structure base.

3. The modular structure of claim 1 further comprising a plurality of structure reinforcing elements extending from said structure base into said structure enclosure.

4. The modular structure of claim 1 further comprising a plurality of unit lift assemblies carried by at least one of said structure base and said structure enclosure.

5. The modular structure of claim 1 further comprising a structure end wall provided on an exposed edge of the roof portion and a respective exposed edge of each side wall portion of at least one of the first modular unit and the second modular unit.

6. The modular structure of claim 1 further comprising a plurality of connector plate assemblies carried by at least one of said structure base and said structure enclosure.

7. The modular structure of claim 6 wherein said plurality of connector plate assemblies each comprises a connector plate and a plurality of connector plate anchor members carried by said connector plate and extending into said at least one of said structure base and said structure enclosure.

8. The modular structure of claim 7 further comprising a connector bracket having a bracket base carried by said connector plate and a bracket flange carried by said bracket base.

9. A modular structure, comprising:

a first modular unit comprising:

a first monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge along each end opening such that a portion of the connector assembly remains exposed;

a first monolithic structure base having an upper surface bounded by a peripheral base edge;

a plurality of structure reinforcement elements extending upward from a peripheral edge of the first monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the first monolithic structure base along an edge respective to each of the at least one end opening, the mechanical connector assemblies positioned having a spatial arrangement, such that a portion of the connector assembly remains exposed;

wherein said first monolithic structure enclosure being of a size and shape for a building and carried by said first monolithic structure base;

wherein said first monolithic structure base is formed via a poured concrete material;

wherein said first monolithic structure enclosure is a unitary structure formed via a form and pouring process; and a structure end wall provided on the exposed edge of the roof portion and the respective exposed edge of each side wall portion of the first modular unit; and a second modular unit comprising:

a second monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge such that a portion of the connector assembly remains exposed;

a second monolithic structure base having an upper surface bounded by a peripheral base edge;

a plurality of structure reinforcement elements extending upward from a peripheral edge of the second monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the second monolithic structure base along an edge respective to each of the at least one end opening, the mechanical connector assemblies positioned having a spatial arrangement, such that a portion of the connector assembly remains exposed and wherein each of the plurality of mechanical connector assemblies are positioned in registration with each mating mechanical connector assembly of a mating end opening of the first modular unit;

wherein said second monolithic structure enclosure being of a size and shape for a building and carried by said second monolithic structure base;

wherein said second monolithic structure base is formed via a poured concrete material;

wherein said second monolithic structure enclosure is a unitary structure formed via a form and pouring process;

wherein the second modular unit is positioned with the second modular end opening abutting the first modular unit one end opening wherein the second modular unit mechanical connector assemblies are in alignment with the first modular unit mechanical connector assemblies in a manner enabling the end openings to mechanically fastened to one another; and wherein each first modular unit mechanical connector assembly is mechanically coupled to each respective second modular unit mechanical connector assembly, thus mechanically joining the first modular unit and the second modular unit together.

10. The modular structure of claim 9 further comprising at least two footers formed along and extending downward from at least two opposing edges of said structure base.

11. The modular structure of claim 9 further comprising a plurality of structure reinforcing elements extending from said structure base into said structure enclosure.

12. The modular structure of claim 9 further comprising a plurality of unit lift assemblies carried by at least one of said structure base and said structure enclosure.

13. The modular structure of claim 9 further comprising at least one structure end wall provided on said side walls and said at least one structure roof section.

14. The modular structure of claim 9 wherein said plurality of unit connector assemblies each comprises a pair of connector plate assemblies carried by adjacent ones of said plurality of connected modular units, respectively; a pair of connector brackets carried by said pair of connector plate assemblies, respectively; and a fastener connecting said pair of connector brackets.

15. The modular structure of claim 14 wherein said pair of connector plate assemblies comprises a pair of connector plates carried by said adjacent ones of said plurality of connected modular units, respectively, and a plurality of connector plate anchor members carried by said pair of connector plates, respectively, and extending into said adjacent ones of said plurality of connected modular units, respectively.

16. A modular structure, comprising:

a first modular unit comprising:

a first monolithic structure enclosure having a roof portion and two opposite side walls portions extending downward from the roof portion, together defining a bottom opening and one end opening;

a plurality of mechanical connector assemblies integrated into the roof portion and each side wall portion proximate an exposed edge along each end opening such that a portion of the connector assembly remains exposed;

a first monolithic structure base having an upper surface bounded by a peripheral base edge;

a plurality of structure reinforcement elements extending upward from a peripheral edge of the first monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the first monolithic structure base along an edge respective to each of the at least one end opening, the mechanical connector assemblies positioned having a spatial arrangement, such that a portion of the connector assembly remains exposed;

wherein said first monolithic structure enclosure being of a size and shape for a building and carried by said first monolithic structure base;

wherein said first monolithic structure base is formed via a poured concrete material;

wherein said first monolithic structure enclosure is a unitary structure formed via a form and pouring process; and a structure end wall provided on the exposed edge of the roof portion and the respective exposed edge of each side wall portion of the first modular unit; and a second modular unit comprising:

a second monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge such that a portion of the connector assembly remains exposed;

a second monolithic structure base having an upper surface bounded by a peripheral base edge;

a plurality of structure reinforcement elements extending upward from a peripheral edge of the second monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed;

a plurality of mechanical connector assemblies integrated into the second monolithic structure base along an edge respective to each of the at least one end opening, the mechanical connector assemblies positioned having a spatial arrangement, such that a portion of the connector assembly remains exposed and wherein each of the plurality of mechanical connector assemblies are positioned in registration with each mating mechanical connector assembly of a mating end opening of the first modular unit;

wherein said second monolithic structure enclosure being of a size and shape for a building and carried by said second monolithic structure base;

wherein said second monolithic structure base is formed via a poured concrete material;

wherein said second monolithic structure enclosure is a unitary structure formed via a form and pouring process;

a structure end wall provided on the exposed edge of the roof portion and the respective exposed edge of each side wall portion of the second modular unit; and wherein the second modular unit is positioned with the second modular end opening abutting the first modular unit one end opening wherein the second modular unit mechanical connector assemblies are in alignment with the first modular unit mechanical connector assemblies in a manner enabling the end openings to mechanically fastened to one another; and wherein each first modular unit mechanical connector assembly is mechanically coupled to each respective second modular unit mechanical connector assembly, thus mechanically joining the first modular unit and the second modular unit together.

17. The modular structure of claim 16 further comprising at least two footers formed along and extending downward from at least two opposing edges of said structure base.

18. The modular structure of claim 17 further comprising a plurality of structure reinforcing elements extending from each of said plurality of structure bases into said plurality of structure enclosures, respectively.

19. The modular structure of claim 17 further comprising at least one of:

(a) a plurality of unit lift assemblies carried by at least one of said structure base and said structure enclosure, (b) a plurality of connector plate assemblies carried by at least one of said structure base and said structure enclosure, (c) a plurality of connector plate assemblies each comprises a connector plate and a plurality of connector plate anchor members carried by said connector plate and extending into said at least one of said structure base and said structure enclosure, and (d) a plurality of connector brackets, each having a bracket base carried by said connector plate and a bracket flange carried by said bracket base.

20. The modular structure of claim 16 further comprising:

a third modular unit comprising:

a third monolithic structure enclosure having a roof portion and two opposite side walls portions extending downward from the roof portion, together defining a bottom opening and at least one end opening;

a plurality of mechanical connector assemblies integrated into the roof portion and each side wall portion proximate an exposed edge along each end opening such that a portion of the connector assembly remains exposed;

a third monolithic structure base having an upper surface bounded by a peripheral base edge;

a plurality of structure reinforcement elements extending upward from a peripheral edge of the third monolithic structure base in a spatial arrangement and in registration for receiving a mating edge of each side wall;

a plurality of mechanical unit lifting assemblies integrated into the base edge in a spatial arrangement, such that a portion of each lifting assembly remains exposed; and a plurality of mechanical connector assemblies integrated into the third monolithic structure base along an edge respective to each of the at least one end opening, the mechanical connector assemblies positioned having a spatial arrangement, such that a portion of the connector assembly remains exposed;

wherein said third monolithic structure enclosure being of a size and shape for a building and carried by said third monolithic structure base;

wherein said third monolithic structure base is formed via a poured concrete material;

wherein said third monolithic structure enclosure is a unitary structure formed via a form and pouring process.

* * * * *